US005803006A

United States Patent [19]

Al-Dokhi

[11] Patent Number: 5,803,006

[45] Date of Patent: Sep. 8, 1998

[54] FLOAT MASTER FOR A WATERCRAFT

[76] Inventor: Mansour Bandar Al-Dokhi, P.O. Box 90390, Riyadh 11613, Saudi Arabia

[21] Appl. No.: 915,538

[22] Filed: Aug. 15, 1997

[51] Int. Cl.[6] ..... B63B 43/14

[52] U.S. Cl. ..... 114/123; 114/122

[58] Field of Search ..... 114/343, 345, 114/364, 121, 122, 123, 68, 366, 373

[56] References Cited

U.S. PATENT DOCUMENTS

| | | | |
|---|---|---|---|
| 633,904 | 9/1899 | Pool | 114/123 |
| 1,705,303 | 3/1929 | Nagy | 114/123 |
| 3,763,813 | 10/1973 | Holtz | 114/123 |
| 3,792,676 | 2/1974 | Craft | 114/123 |
| 3,822,662 | 7/1974 | Morita et al. | 114/123 |
| 3,844,241 | 10/1974 | Black et al. | 114/123 |
| 4,996,936 | 3/1991 | Brundritt | 114/123 |
| 5,263,434 | 11/1993 | Mashburn et al. | 114/123 |

*Primary Examiner*—Stephen Avila
*Attorney, Agent, or Firm*—Michael I. Kroll

[57] ABSTRACT

A float master (12) for a watercraft (14) comprising a telescopic arm (16). A structure (18) is for securing a first end (20) of the telescopic arm (16) to a deck (22) of the watercraft (14). An inflatable raft (24) is provided. A component (26) is for attaching the inflatable raft (24) to a second end (28) of the telescopic arm (16). A facility (30) connected to the telescopic arm (16) is for extending the telescopic arm (16) in an angular direction down towards a body of water (32) about the watercraft (14). An assembly (34) connected to the inflatable raft (24) is for inflating the inflatable raft (24) in the body of water (32) after the telescopic arm (16) is completely extended, so that the inflatable raft (24) will stabilize the watercraft (14) in an upright position within the body of water (32).

19 Claims, 7 Drawing Sheets

FLOAT MASTER FOR A WATERCRAFT

BACKGROUND OF THE INVENTION

1. Field of the Invention

The instant invention relates generally to buoyant devices and more specifically it relates to a float master for a watercraft. The float master for a watercraft will keep the watercraft in a normal balanced upright position, if the watercraft starts to tip to one side during an emergency.

2. Description of the Prior Art

Numerous buoyant devices have been provided in prior art. For example, U.S. patents numbered U.S. Pat. No. 1,705,303 to Nagy; U.S. Pat. No. 3,792,676 to Craft; U.S. Pat. No. 3,822,662 to Morita et al.; U.S. Pat. No. 3,844,241 to Black et al. and U.S. Pat. No. 4,996,936 to Brundritt all are illustrative of such prior art. While these units may be suitable for the particular purpose to which they address, they would not be as suitable for the purposes of the present invention as heretofore described.

NAGY, LOUIS

NONSINKABLE SHIP

U.S. Pat. No. 1,705,303

In combination with a ship, pontoons are hingedly mounted to the sides of the ship in proximity to the water line of the ship. Rods are secured on the pontoons on the sides remote from the sides hingedly connected to the ship. Link members are pivoted to the rods. Other rods are secured through the free ends of the link members. Other link members are connected to the second mentioned rods. Still other rods are secured to the sides of the ship. The free ends of the second mentioned link members are pivotally arranged on the last mentioned rods. Flexible members are secured to the first mentioned rods and provided with a means for drawing or slackening three flexible members. Towers project from the ship slides are arranged on the towers. Connecting levers are arranged between the slides and the first mentioned rods. Flexible members are secured to the slides and are provided with a means for drawing or slackening these flexible members.

CRAFT, WALTER BOONE

BALLAST ATTACHMENT FOR BOATS

U.S. Pat. No. 3,792,676

An adjustable ballast attachment for use on boats for stability and to prevent capsizing. The attachment may be folded inwardly of the boat while traveling at high speed and extend to stabilize the boat while moving at low speed or not moving at all.

MORITA, KATSAO

HASHIMOTO, SADAO

MIYAMOTO, HIROSHI

SAFETY DEVICE FOR SHIP

U.S. Pat. No. 3,822,662

A ship safety device comprising normally folded inflatable gas bags secured to broadsides of a ship. The gas bags are connected to a pressure-gas source through a valve for selective inflation in emergency. Each gas bag has a flange, which is secured to the ship broadside by fixtures, and two folding portions extending in the longitudinal direction of the ship, for facilitating the folding thereof in an easily inflatable and deflatable fashion.

BLACK, HARRY G.

CHRISTENSON, LOWELL B.

AUXILIARY FLOTATION FOR REDUCING THE DRAFT OF SHIPS

U.S. Pat. No. 3,844,241

Auxiliary flotation means for reducing the draft of a ship, so that it may operate in shallower waters. A plurality of expansible pneumatically inflatable bellows shaped flotation bags are supported from a load-bearing structure which is pivotally and slideably supported from tracks on the side of the ship. A control arm pivotally connected to the side of the ship and slideably connected to the load-bearing structure is for rotating the bags outwardly from the ship and into a supporting position, and for rotating the bags inwardly against the side of the ship and into a raised retracted position. Stop means are provided at the lower end of the track for limiting the downward sliding movement of the load-bearing structure to place the structure in the horizontal position. Hydraulic piston and cylinder means are connected between the control arm and the ship, for rotating the control arm and for holding the load-bearing structure to a horizontal position when the bags are inflated. And a buoyancy chamber may be connected to the outer end of the load-bearing structure to assist in rotating the load-bearing structure to a horizontally extended position.

BRUNDRITT, LARRY W.

EMERGENCY FLOTATION DEVICE FOR WATERCRAFT

U.S. Pat. No. 4,996,936

A buoyant support for a watercraft comprises a rigid, elongated support surface, and an inflatable member folded along its length in a substantially deflated condition to form a relatively compact, resilient mass secured to and overlaying the surface. A cover or the like retains the inflatable member in its folded, overlaying condition. In an emergency, the inflatable member is inflated to provide the buoyant support. In the folded condition, the device may act as a fender for the watercraft.

SUMMARY OF THE INVENTION

A primary object of the present invention is to provide a float master for a watercraft that will overcome the shortcomings of the prior art devices.

Another object is to provide a float master for a watercraft, in which a float can be inflated after a telescopic arm is extended at an angle downwardly from a side of the watercraft, so as to keep the watercraft in its normal balanced upright position within a body of water.

An additional object is to provide a float master for a watercraft that is built into the watercraft, so that it can be stored with the telescopic arm in a retracted position and the float deflated, ready to be utilized in an emergency when the watercraft starts to tip to one side.

A further object is to provide a float master for a watercraft that is simple and easy to use.

A still further object is to provide a float master for a watercraft that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1B:
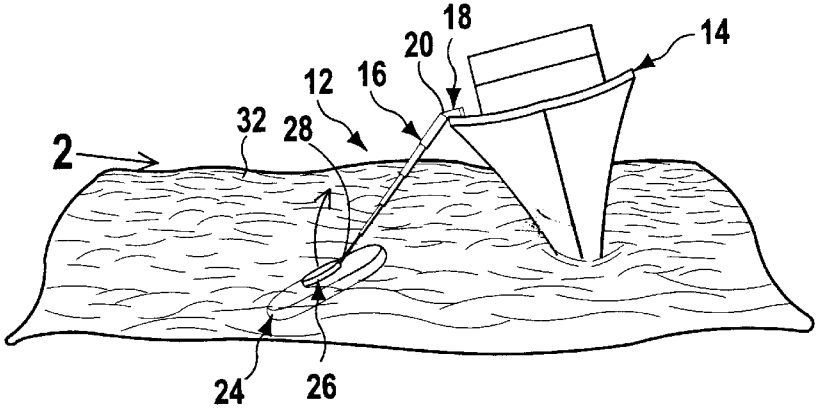
FIG. 1B is a front elevational view similar to FIG. 1A, showing the instant invention deployed from the watercraft.
Figure 1D:
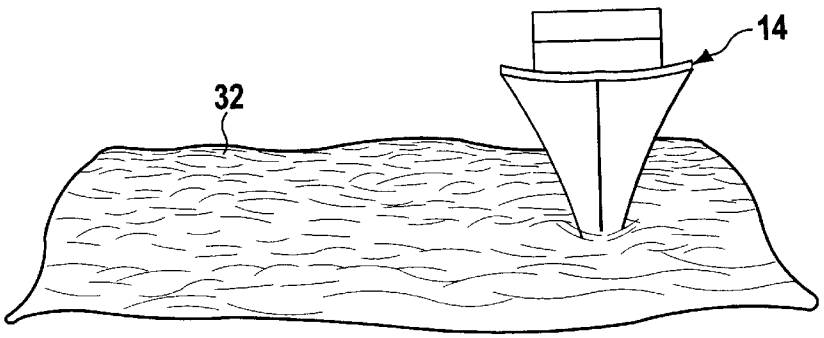
FIG. 1D is a front elevational view similar to FIG. 1A, showing the watercraft in its upright stabilized position after the instant invention is deflated, retracted and stored therein.
Figure 1A:
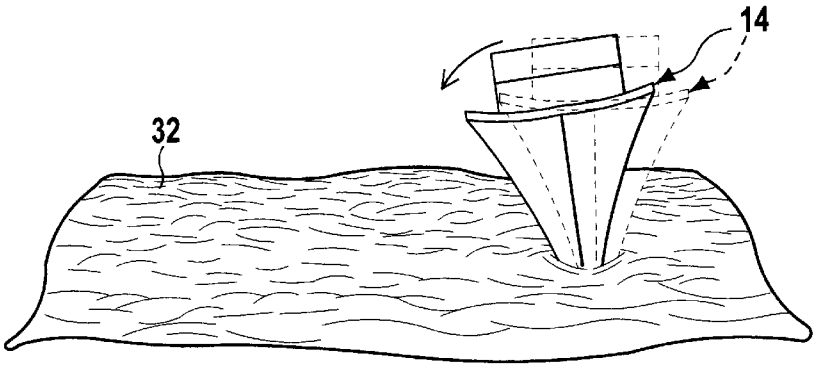
FIG. 1A is a front elevational view of a watercraft in a body of water tipping to one side.
Figure 1C:
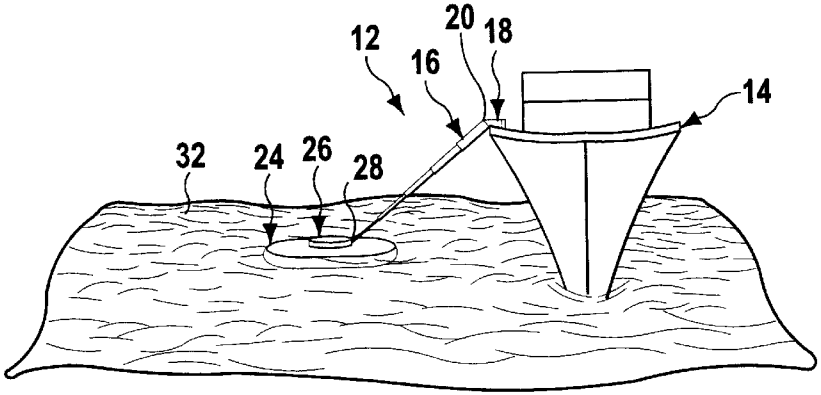
FIG. 1C is a front elevational view similar to FIG. 1B, showing the instant invention stabilizing the watercraft in an upright position.
Figure 2:
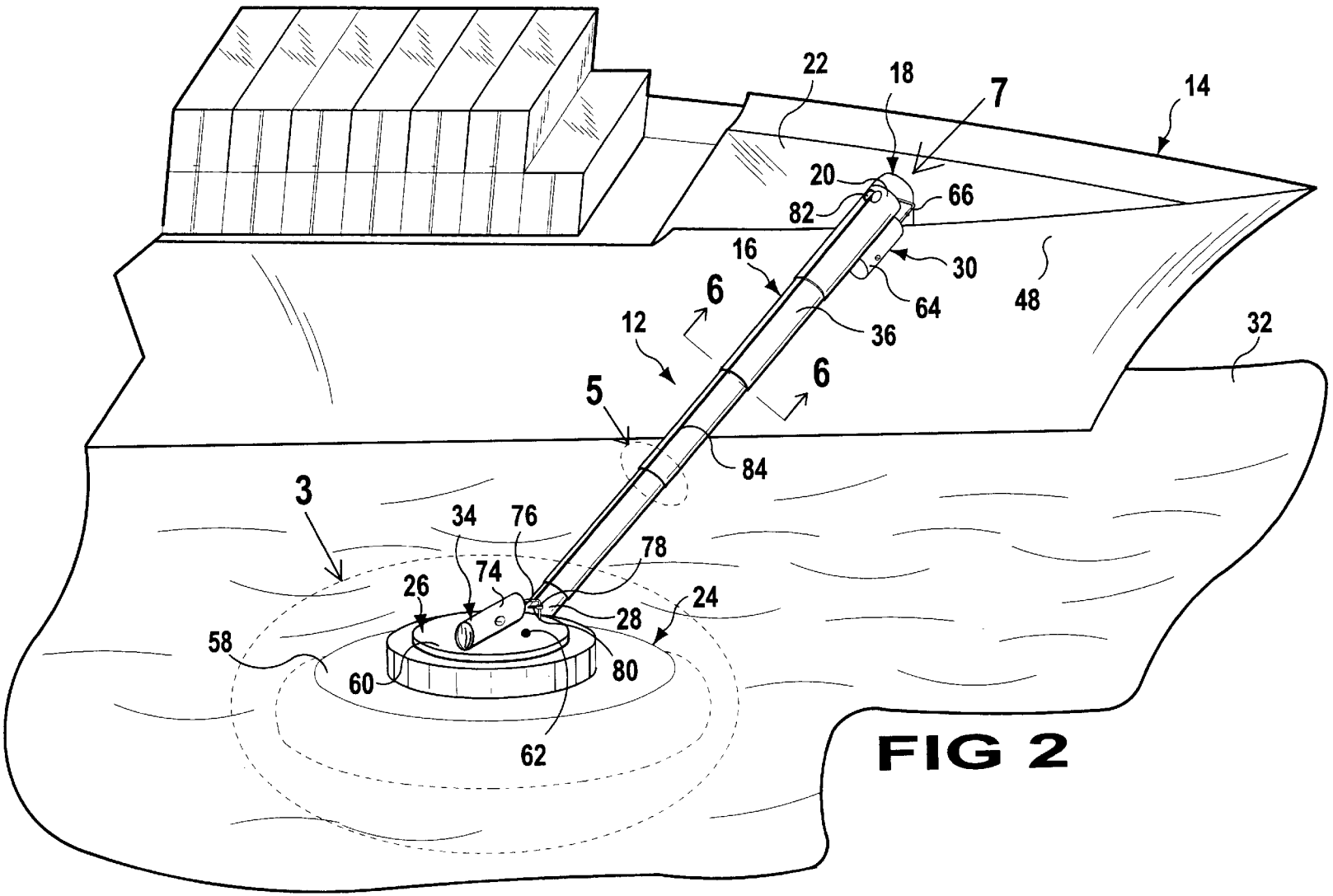
FIG. 2 is an enlarged perspective view taken in the direction of arrow 2 in FIG. 1B.
Figure 3:
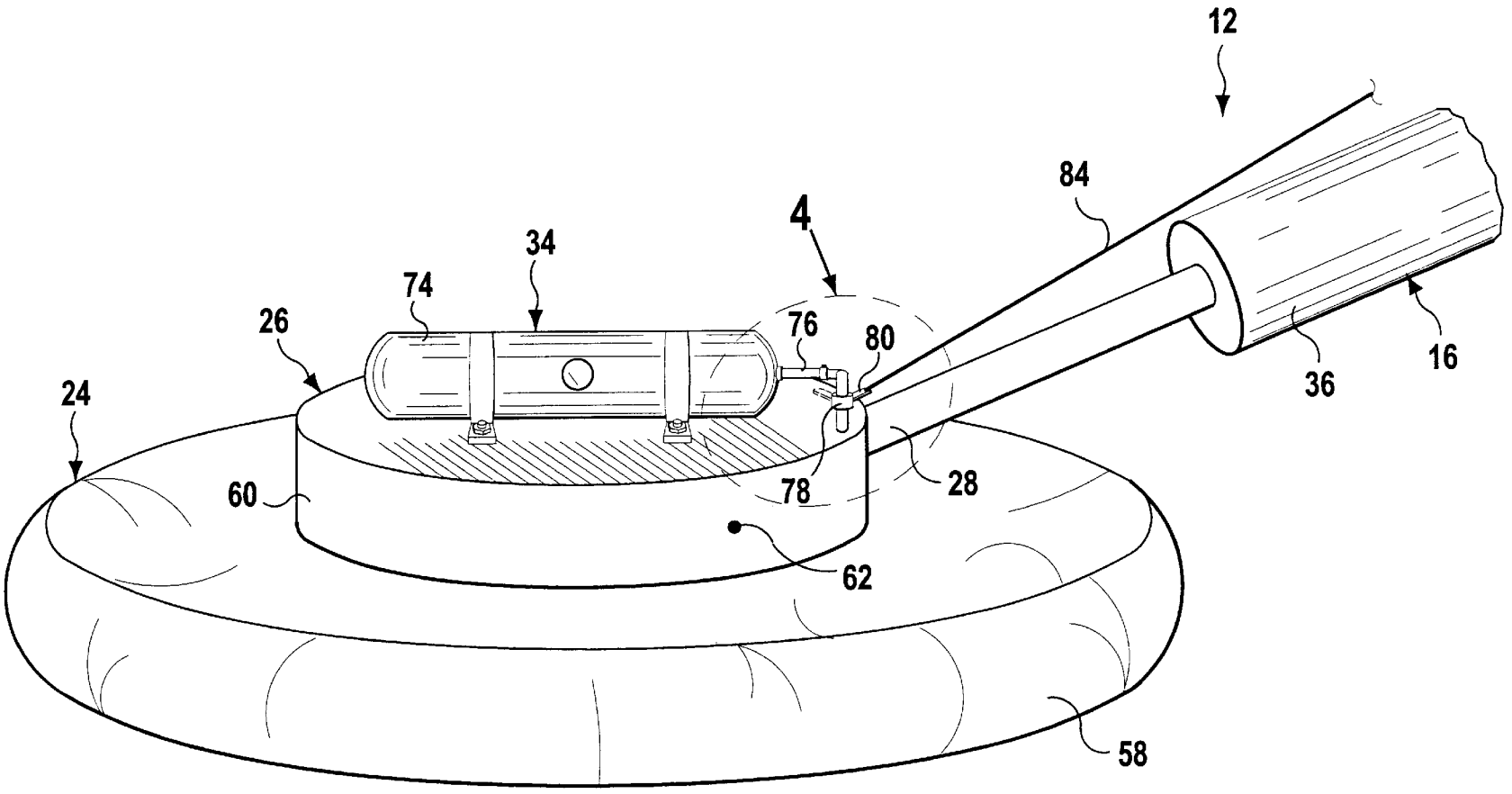
FIG. 3 is a further enlarged perspective view of an area in FIG. 2 as indicated by arrow 3.
Figure 4:
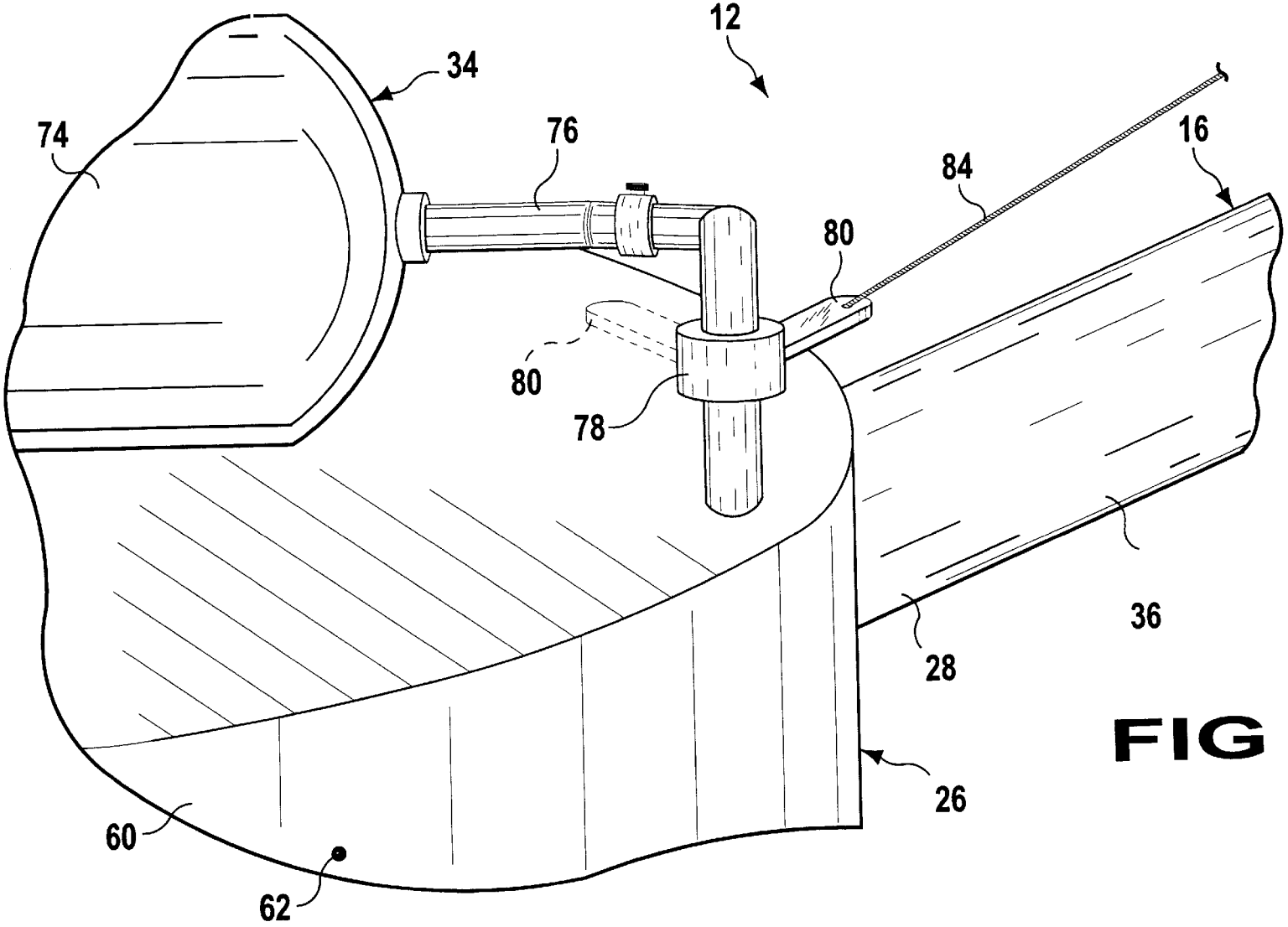
FIG. 4 is a still further enlarged perspective view of an area in FIG. 3 as indicated by arrow 4.

Turning now descriptively to the drawings, in which similar reference characters denote similar elements throughout the several views, FIGS. 1A through 10 illustrate a float master 12 for a watercraft 14. With regard to the reference numerals used, the following numbering is used throughout the various drawing figures.

12 float master for 14
14 watercraft
16 telescopic arm of 12
18 securing structure of 12
20 first end of 16
22 deck of 14
24 inflatable raft of 12
26 attaching component of 12
28 second end of 16
30 extending facility of 12
32 body of water
34 inflating assembly of 12
36 hollow sealed cylindrical segment of 16
38 annular lock of 16
40 frame member of 18
42 first end of 40
44 mounting assemblage of 18
46 second end of 40
48 side wall of 14
50 drop rail lock of 18
52 fold bracket of 50
54 first pivot connector between 50 and 22
56 second pivot connector between 50 and 40
58 large generally disk shaped bladder for 24
60 disk shaped support plate for 26
62 buoyant material of 60
64 extension pressurized gas cylinder of 30
66 conduit of 30
68 extension valve of 30
70 deployment handle of 68
72 safety pin of 68
74 inflation pressurized gas cylinder of 34
76 tubing of 34
78 inflation valve of 34
80 lever of 78
82 spool of 78
84 elongate cable of 78 between 82 and 80

The float master 12 for the watercraft 14 comprises a telescopic arm 16. A structure 18 is for securing a first end 20 of the telescopic arm 16 to a deck 22 of the watercraft 14. An inflatable raft 24 is provided. A component 26 is for attaching the inflatable raft 24 to a second end 28 of the telescopic arm 16. A facility 30 connected to the telescopic arm 16 is for extending the telescopic arm 16 in an angular direction down towards a body of water 32 about the watercraft 14. An assembly 34 connected to the inflatable raft 24 is for inflating the inflatable raft 24 in the body of water 32 after the telescopic arm 16 is completely extended, so that the inflatable raft 24 will stabilize the watercraft 14 in an upright position within the body of water 32.

Figure 5:
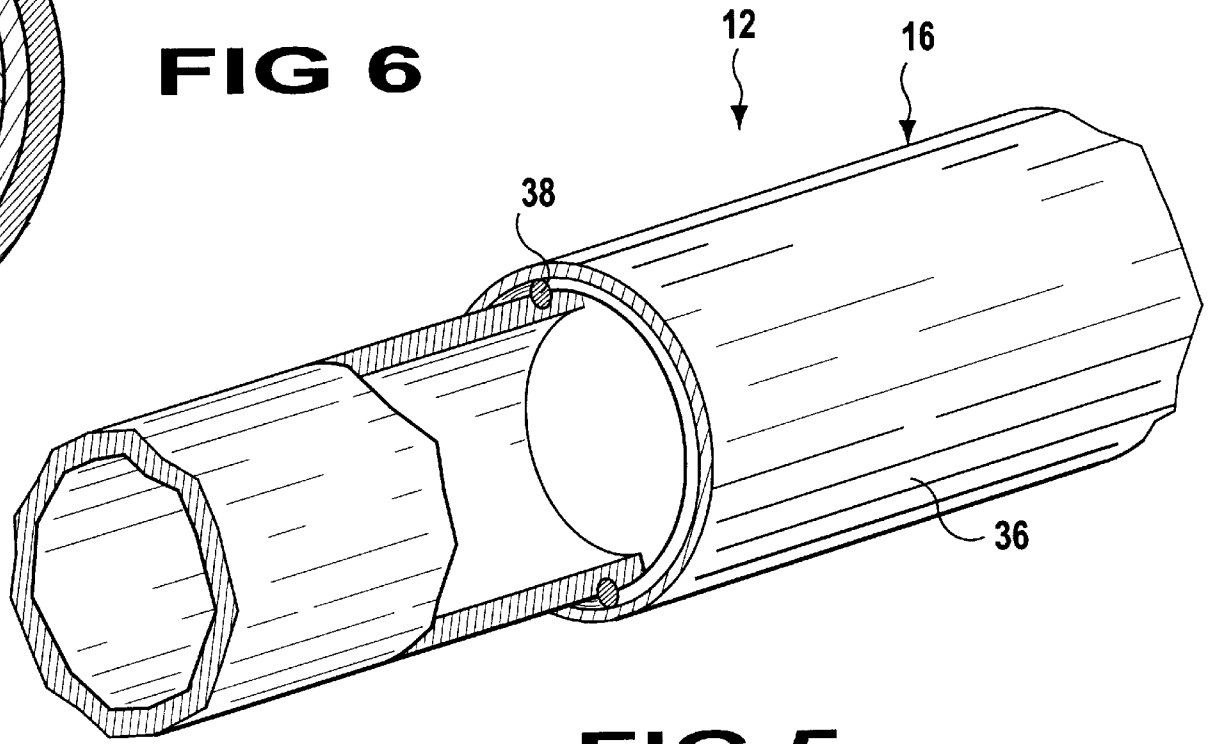
FIG. 5 is a further enlarged perspective view of an area in FIG. 2 as indicated by arrow 5, with parts broken away and in section.
Figure 6:
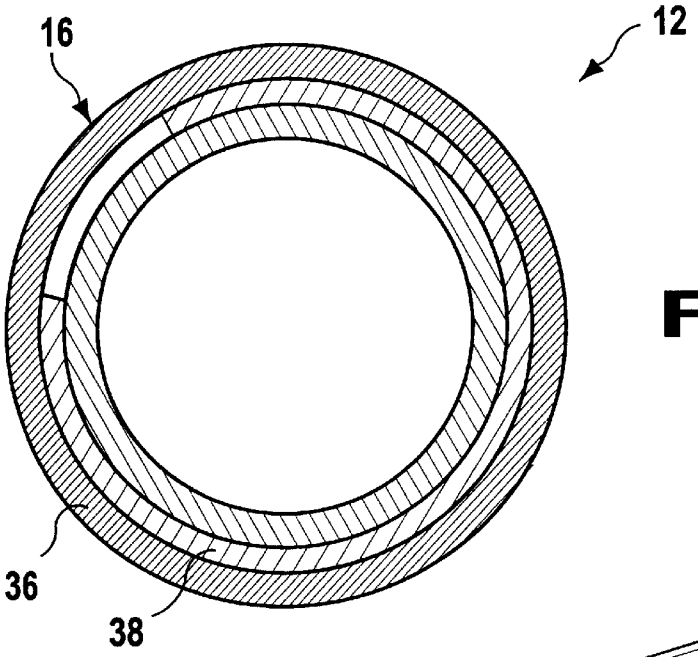
FIG. 6 is a further enlarged cross sectional view taken along line 6—6 in FIG. 2.

The telescopic arm 16, as best seen in FIGS. 5 and 6, includes a plurality of hollow sealed cylindrical segments 36, in which the hollow sealed cylindrical segments 36 are sized to fit one within the other. A plurality of annular locks 38 are provided. Each annular lock 38 is between interconnecting ends of the hollow sealed cylindrical segments 36 of the telescopic arm 16.

Figure 8:
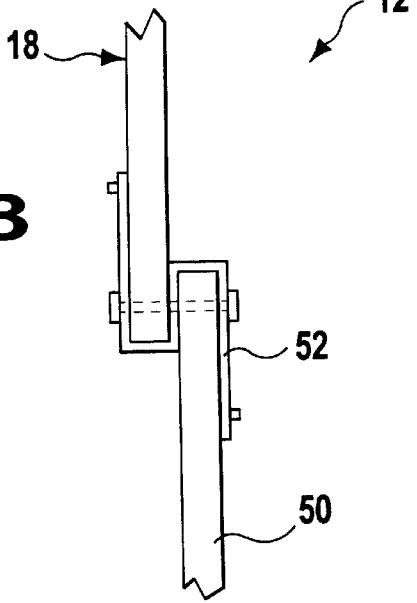
FIG. 8 is an end view taken in the direction of arrow 8 in FIG. 7, with parts broken away.
Figure 7:
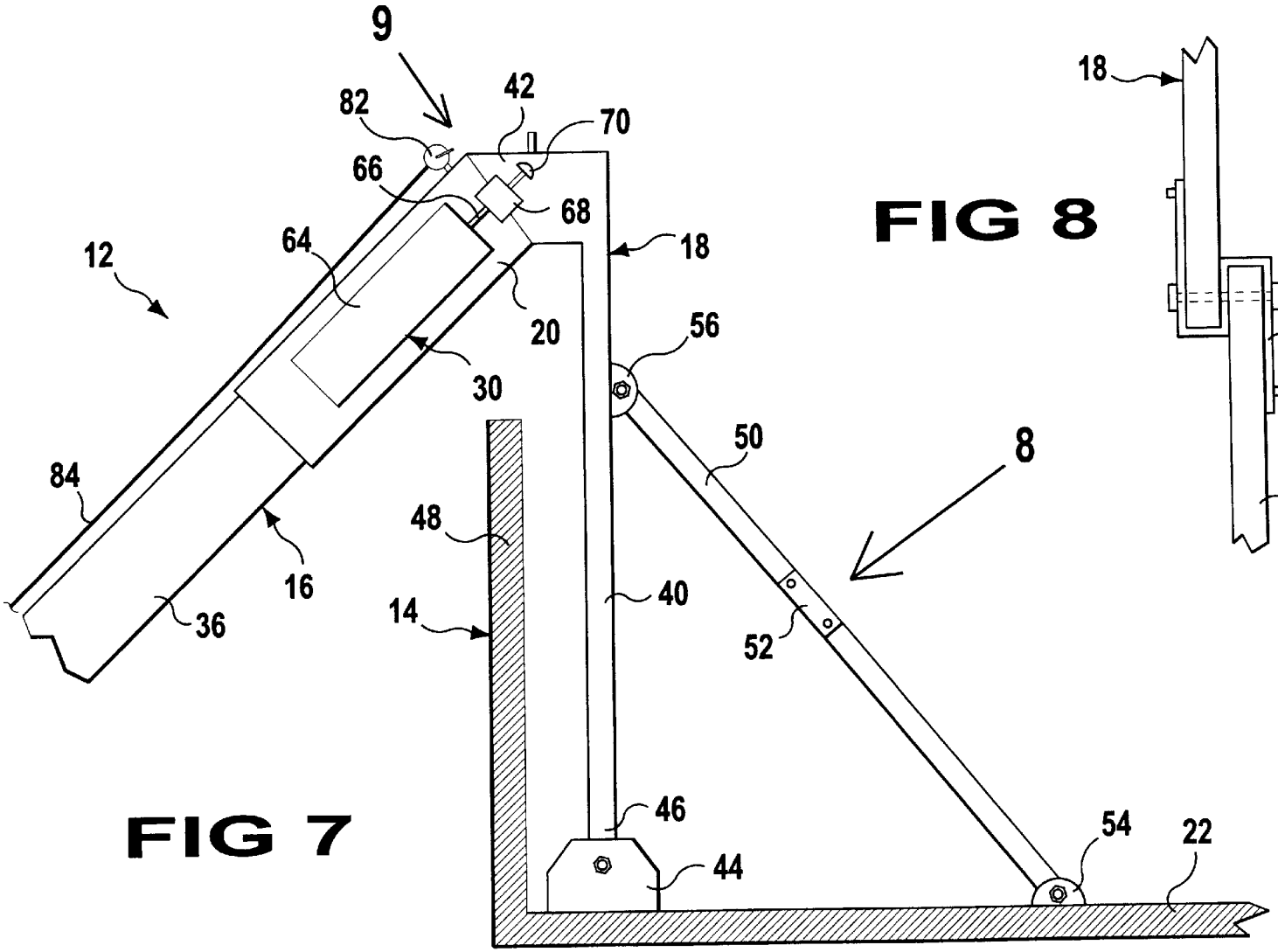
FIG. 7 is a further enlarged side view taken in the direction of arrow 7 in FIG. 2.
Figure 10:
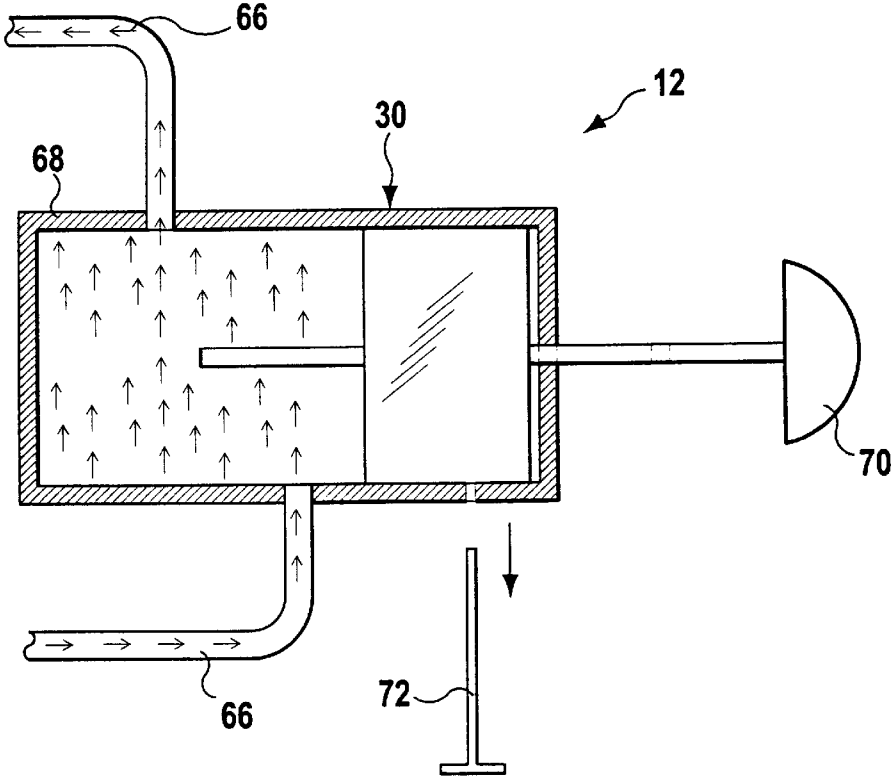
FIG. 10 is a top view similar to FIG. 9, showing the safety pin removed and the deployment handle pulled, to activate the extension valve.
Figure 9:
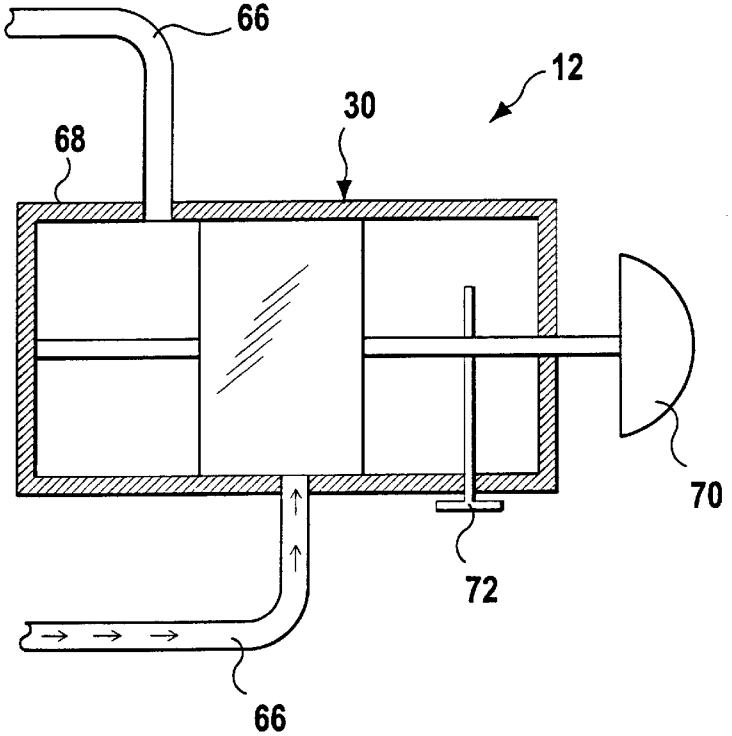
FIG. 9 is a further enlarged top view taken in the direction of arrow 9 in FIG. 7, with parts broken away and in section of the extension valve.

The securing structure 18, as best seen in FIGS. 7 and 8, consists of a frame member 40 attached at a first end 42 to the telescopic arm 16. An assemblage 44 is for mounting in a pivotable manner a second end 46 of the frame member 40 to the deck 22 and adjacent a side wall 48 of the watercraft 14. The frame member 40 can pivot between a horizontal stored position to a vertical operable position. A drop rail lock 50 has a fold bracket 52 therebetween. A first pivot connector 54 is between a lower end of the drop rail lock 50 and the deck 22 of the watercraft 14. A second pivot connector 56 is between an upper end of the drop rail lock 50 and one side of the frame member 40. The drop rail lock 50 will extend at an angle between the deck 22 of the watercraft 14 and the frame member 40, to maintain the frame member 40 in the vertical operable position.

The inflatable raft 24 is a large generally disk shaped bladder 58 which will float on the body of water 32. The attaching component 26 is a disk shaped support plate 60 fabricated out of a buoyant material 62, which is mounted upon the inflatable raft 24 and connected at one side to the second end 28 of the telescopic arm 16.

The extending facility 30 includes an extension pressurized gas cylinder 64 mounted adjacent to the first end 20 of the telescopic arm 16. A conduit 66 extends between the extension pressurized gas cylinder 64 and the first end 20 of the telescopic arm 16. An extension valve 68 in the conduit 66 allows the pressurized gas within the extension pressurized gas cylinder 64 to flow into the telescopic arm 16 and cause the telescopic arm 16 to extend from the watercraft 14.

The extension valve 68 contains a deployment handle 70, which when manually pulled will open the extension valve 68 to allow the pressurized gas to flow therethrough. A safety pin 72 is transversely inserted within the extension valve 68 to engage with the deployment handle 70. Before the deployment handle 70 can be manually pulled, the safety pin 72 must be removed from the extension valve 68.

The inflating assembly 34 comprises an inflation pressurized gas cylinder 74 mounted onto the attaching component 26. A tubing 76 extends between the inflation pressurized gas cylinder 74 and the inflatable raft 24. An inflation valve 78 in the tubing 76 allows the pressurized gas within the inflation pressurized gas cylinder 74 to flow into the inflatable raft 24 and cause the inflatable raft 24 to inflate.

The inflation valve 78 includes a lever 80, which when manually operated will open the inflation valve 78, to allow the pressurized gas to flow therethrough. A spool 82 is mounted onto the first end 20 of the telescopic arm 16. An elongate cable extends from the spool 82 to the lever 80, so that after the telescopic arm 16 is extended, the elongate cable 84 will cause the lever 80 to turn and operate the inflation valve 78 when the spool 82 is manually rotated.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A float master for a watercraft comprising:

a) a telescopic arm;

b) means for securing a first end of said telescopic arm to a deck of the watercraft;

c) an inflatable raft;

d) means for attaching said inflatable raft to a second end of said telescopic arm;

e) means connected to said telescopic arm for extending said telescopic arm in an angular direction down towards a body of water about the watercraft; and f) means connected to said inflatable raft for inflating said inflatable raft in the body of water after said telescopic arm is completely extended, so that said inflatable raft will stabilize the watercraft in an upright position within the body of water.

2. A float master for a watercraft as recited in claim 1, wherein said telescopic arm includes:

a) a plurality of hollow sealed cylindrical segments, in which said hollow sealed cylindrical segments are sized to fit one within the other; and b) a plurality of annular locks, in which each said annular lock is between interconnecting ends of said hollow sealed cylindrical segments of said telescopic arm.

3. A float master for a watercraft as recited in claim 1, wherein said securing means includes:

a) a frame member attached at a first end to said telescopic arm; and b) means for mounting in a pivotable manner a second end of said frame member to the deck and adjacent a side wall of the watercraft, so that said frame member can pivot between a horizontal stored position to a vertical operable position.

4. A float master for a watercraft as recited in claim 3, wherein said securing means further includes:

a) a drop rail lock having a fold bracket therebetween;

b) a first pivot connector between a lower end of said drop rail lock and the deck of the watercraft; and c) a second pivot connector between an upper end of said drop rail lock and one side of said frame member, so that said drop rail lock will extend at an angle between the deck of the watercraft and said frame member to maintain said frame member in the vertical operable position.

5. A float master for a watercraft as recited in claim 1, wherein said inflatable raft is a large generally disk shaped bladder which will float on the body of water.

6. A float master for a watercraft as recited in claim 1, wherein said attaching means is a disk shaped support plate fabricated out of a buoyant material which is mounted upon said inflatable raft and connected at one side to said second end of said telescopic arm.

7. A float master for a watercraft as recited in claim 1, wherein said extending means includes:

a) an extension pressurized gas cylinder mounted adjacent to said first end of said telescopic arm;

b) a conduit extending between said extension pressurized gas cylinder and said first end of said telescopic arm; and c) an extension valve in said conduit to allow the pressurized gas within said extension pressurized gas cylinder to flow into said telescopic arm and cause said telescopic arm to extend from the watercraft.

8. A float master for a watercraft as recited in claim 7, wherein said extension valve includes:

a) a deployment handle which when manually pulled will open said extension valve to allow the pressurized gas to flow therethrough; and b) a safety pin transversely inserted within said extension valve to engage with said deployment handle, so that before said deployment handle can be manually pulled, said safety pin must be removed from said extension valve.

9. A float master for a watercraft as recited in claim 1, wherein said inflating means includes:

a) an inflation pressurized gas cylinder mounted onto said attaching means;

b) a tubing extending between said inflation pressurized gas cylinder and said inflatable raft; and c) an inflation valve in said tubing to allow the pressurized gas within said inflation pressurized gas cylinder to flow into said inflatable raft and cause said inflatable raft to inflate.

10. A float master for a watercraft as recited in claim 9, wherein said inflation valve includes:

a) a lever which when manually operated will open said inflation valve to allow the pressurized gas to flow therethrough;

b) a spool mounted onto said first end of said telescopic arm; and c) an elongate cable extending from said spool to said lever, so that after said telescopic arm is extended said elongate cable will cause said lever to turn and operate said inflation valve when said spool is manually rotated.

11. A float master for a watercraft comprising:

a) a telescopic arm, wherein said telescopic arm includes a plurality of hollow sealed cylindrical segments, in which said hollow sealed cylindrical segments are sized to fit one within the other and a plurality of annular locks, in which each said annular lock is between interconnecting ends of said hollow sealed cylindrical segments of said telescopic arm;

b) means for securing a first end of said telescopic arm to a deck of the watercraft;

c) an inflatable raft;

d) means for attaching said inflatable raft to a second end of said telescopic arm;

e) means connected to said telescopic arm for extending said telescopic arm in an angular direction down towards a body of water about the watercraft; and f) means connected to said inflatable raft for inflating said inflatable raft in the body of water after said telescopic arm is completely extended, so that said inflatable raft will stabilize the watercraft in an upright position within the body of water.

12. A float master for a watercraft as recited in claim 11, wherein said securing means includes:

a) a frame member attached at a first end to said telescopic arm; and b) means for mounting in a pivotable manner a second end of said frame member to the deck and adjacent a side wall of the watercraft, so that said frame member can pivot between a horizontal stored position to a vertical operable position.

13. A float master for a watercraft as recited in claim 12, wherein said securing means further includes:

a) a drop rail lock having a fold bracket therebetween;

b) a first pivot connector between a lower end of said drop rail lock and the deck of the watercraft; and c) a second pivot connector between an upper end of said drop rail lock and one side of said frame member, so that said drop rail lock will extend at an angle between the deck of the watercraft and said frame member to maintain said frame member in the vertical operable position.

14. A float master for a watercraft as recited in claim 13, wherein said inflatable raft is a large generally disk shaped bladder which will float on the body of water.

15. A float master for a watercraft as recited in claim 14, wherein said attaching means is a disk shaped support plate fabricated out of a buoyant material which is mounted upon said inflatable raft and connected at one side to said second end of said telescopic arm.

16. A float master for a watercraft as recited in claim 15, wherein said extending means includes:

a) an extension pressurized gas cylinder mounted adjacent to said first end of said telescopic arm;

b) a conduit extending between said extension pressurized gas cylinder and said first end of said telescopic arm; and c) an extension valve in said conduit to allow the pressurized gas within said extension pressurized gas cylinder to flow into said telescopic arm and cause said telescopic arm to extend from the watercraft.

17. A float master for a watercraft as recited in claim 16, wherein said extension valve includes:

a) a deployment handle which when manually pulled will open said extension valve to allow the pressurized gas to flow therethrough; and b) a safety pin transversely inserted within said extension valve to engage with said deployment handle, so that before said deployment handle can be manually pulled, said safety pin must be removed from said extension valve.

18. A float master for a watercraft as recited in claim 17, wherein said inflating means includes:

a) an inflation pressurized gas cylinder mounted onto said attaching means;

b) a tubing extending between said inflation pressurized gas cylinder and said inflatable raft; and c) an inflation valve in said tubing to allow the pressurized gas within said inflation pressurized gas cylinder to flow into said inflatable raft and cause said inflatable raft to inflate.

19. A float master for a watercraft as recited in claim 18, wherein said inflation valve includes:

a) a lever which when manually operated will open said inflation valve to allow the pressurized gas to flow therethrough;

b) a spool mounted onto said first end of said telescopic arm; and c) an elongate cable extending from said spool to said lever, so that after said telescopic arm is extended said elongate cable will cause said lever to turn and operate said inflation valve when said spool is manually rotated.

* * * * *